US005569057A

United States Patent [19]

Barsdorf et al.

[11] Patent Number: 5,569,057

[45] Date of Patent: Oct. 29, 1996

[54] BODY SURFING DEVICE

[75] Inventors: Gary K. Barsdorf, 12A Logan Place, Red Hill, 4051, South Africa; Deon D. Schoeman, Red Hill, South Africa

[73] Assignee: Gary Keith Barsdorf, Red Hill, South Africa

[21] Appl. No.: 504,246

[22] Filed: Jul. 19, 1995

[30] Foreign Application Priority Data

Jul. 20, 1994 [ZA] South Africa ..... 94/5309

[51] Int. Cl.[6] ..... B63B 1/00

[52] U.S. Cl. ..... 441/65; 441/117; 441/74

[58] Field of Search ..... 441/55, 65, 74, 441/79, 117, 118, 129, 80, 88

[56] References Cited

U.S. PATENT DOCUMENTS

| | | | |
|---|---|---|---|
| 1,510,532 | 10/1924 | Zorn | 441/65 |
| 1,552,603 | 9/1925 | Hawks | 441/65 |
| 1,647,677 | 11/1927 | Weeks et al. . | |
| 1,654,299 | 12/1927 | McDonald | 441/117 |
| 3,803,652 | 4/1974 | Uyehara | 441/117 |
| 4,623,316 | 11/1986 | Ratliff | 441/117 |
| 4,708,675 | 11/1987 | Shoeffler et al. | 441/65 |
| 4,886,476 | 12/1989 | Brocone et al. . | |
| 5,015,208 | 5/1991 | Fox et al. | 441/65 |
| 5,106,331 | 4/1992 | Lizarazu | 441/55 |
| 5,173,068 | 12/1992 | Dunn et al. | 441/65 |
| 5,224,890 | 7/1993 | Moran | 441/65 |

*Primary Examiner*—Edwin L. Swinehart

*Attorney, Agent, or Firm*—Woodard, Emhardt, Naughton, Moriarty & McNett

[57] ABSTRACT

A body surfing device 10 consisting of a board 12 and a harness 14 secured to the board 12 for strapping the board to the front torso part of a person's body. The board 12 has an upper face 16, a lower face 18, a leading end 20, a trailing end 22 and two sides 24. The board 12 is of waterproof foam rubber having a plastics sheet element attached to the underside thereof, which defines the lower face 18 of the board 12. The harness 14 is attached to the board 12 at four attachment locations and comprises two shoulder straps 40 which are disposed to extend around the shoulders of a person when the board is strapped to him, a waist strap 42 disposed to extend around the person's waist and two connecting straps 44 which are formed integrally with the shoulder straps 40 and which are connected to the waist strap 42.

10 Claims, 4 Drawing Sheets

BODY SURFING DEVICE

This invention relates to a body surfing device.

"Body surfing" generally refers to the sport of "riding" a wave in a prone position by being propelled by the force of the wave towards shore. In order to change direction while riding a wave, a person uses his arms and hands by dragging them in the water and can also alter his body position in the water to change direction as required.

Another sport which involves riding a wave in a prone position is the sport of "body boarding". In this sport a person is buoyantly supported on a "body board" in a prone position while riding a wave. Typically, such a body board supports the torso of a person while riding a wave while the person holds onto the body board with his hands, with steering of the body board being achieved by shifting the person's weight on the board.

It is an object of the present invention to provide a body surfing device which allows for the speed and manoeuvrability on a wave associated with body boarding together with the freedom of movement associated with body surfing.

According to the invention, there is provided a body surfing device for riding water waves, comprising a board having an upper face, a lower face, a leading end, a trailing end and two sides extending between the leading and trailing ends, and a harness secured to the board for strapping the board to the front torso part of a person's body, with the upper face of the board abutting the person's torso.

The upper face of the board may define a recess formation formed to receive the front torso part of a person therein.

The lower face of the board may define a smooth surface which is substantially planar over a major part of the lower face and which curves upwardly at the leading end of the board.

The sides may define a generally convex configuration when viewed in plan view.

Each side of the board may define two side segments comprising an upper side segment and a lower side segment extending angularly from an outer side edge of the board to the upper face and the lower face of the board, respectively.

The lower side segment of each side of the board may taper from a central region thereof toward the leading and trailing ends of the board, with the upper side segment tapering from the leading and trailing ends of the board toward a central region of the upper side segment.

The leading end of the board may define a concave edge formation to permit free movement of the head of a person when the board is operatively strapped to him.

The trailing end of the board may define a concave edge formation to accommodate the abdomen of a person when the board is strapped to him.

The harness may comprise a number of straps disposed to extend around the waist and shoulders of a person when the board is strapped to him, selected straps including securing means which permit the selected straps to be secured to one another and tightened around the waist and shoulders of the person.

The body surfing device may include two leg straps which are each secured to the board and disposed to extend therefrom around the upper regions of the legs of a person via the person's crotch region and back to the board, when the board is strapped to him.

Selected straps may be releasably secured to one another to permit a person to fit and remove the harness from his body.

The body surfing device may include at least one fin which is secured to the board to extend from the lower face of the board.

Further features of the body surfing device of the invention, including the mode of use thereof, are described hereinafter with reference to a non-limiting example of the invention, illustrated in the accompanying diagrammatic drawings. In the drawings.

Figure 1:
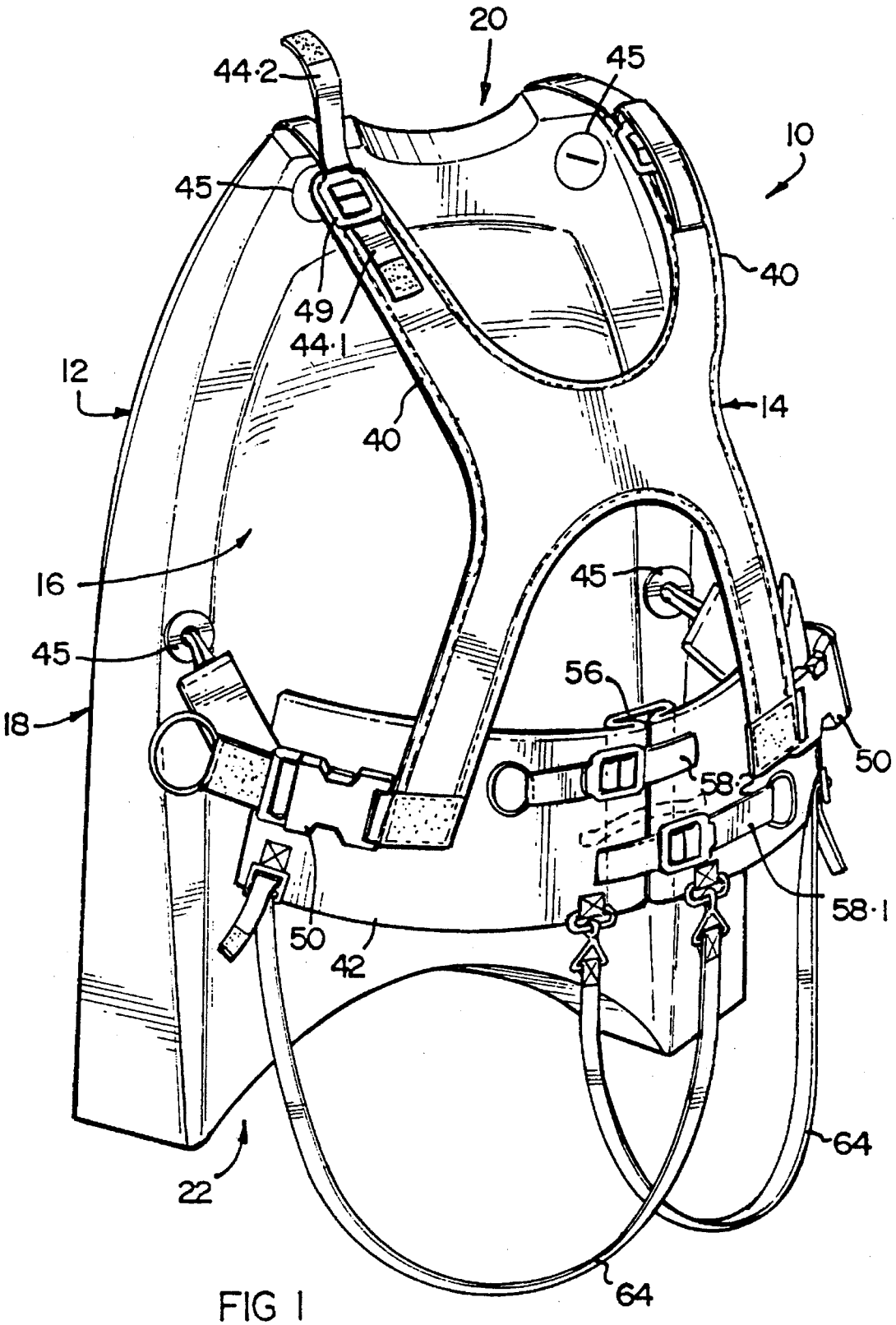
FIG. 1 shows a three-dimensional view of a body surfing device in accordance with the invention.
Figure 2:
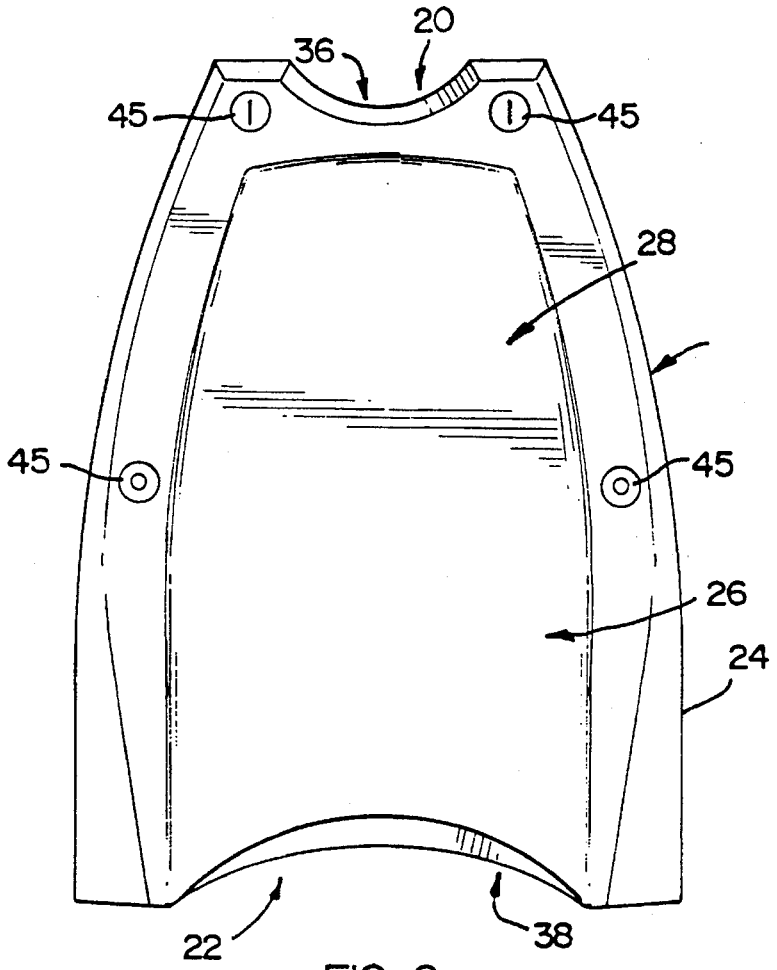
FIG. 2 shows in plan view the upper side of a board of the body surfing device of FIG. 1.
Figure 3:
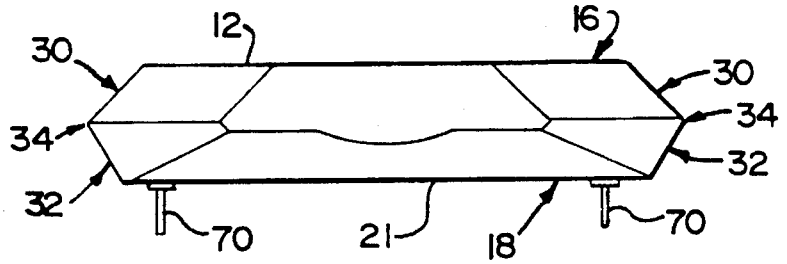
FIG. 3 shows a front view of the board of FIG. 2.
Figure 4:
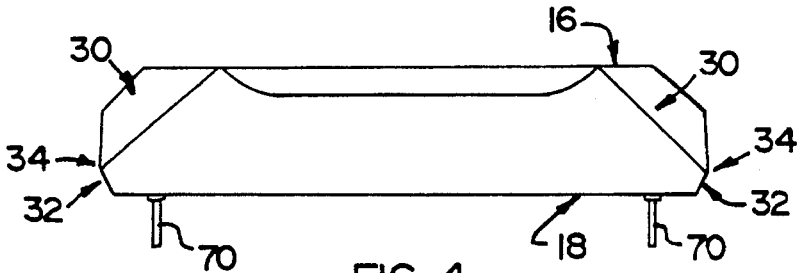
FIG. 4 shows a rear view of the board of FIG. 2.
Figure 5:
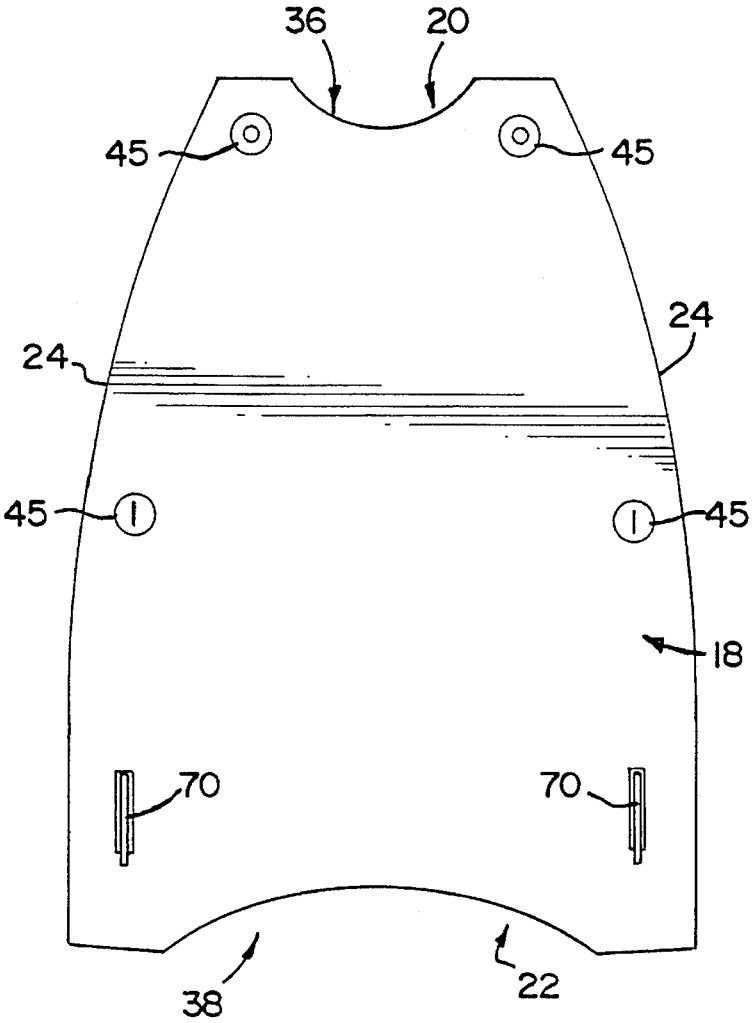
FIG. 5 shows in plan view the under side of the board of FIG. 2.
Figure 6:
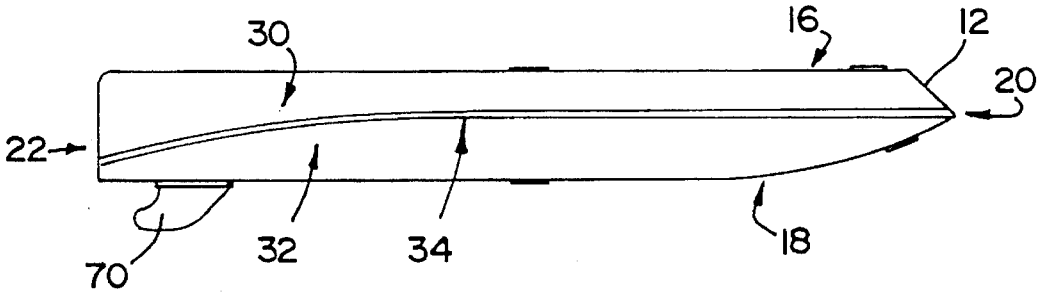
FIG. 6 shows a side view of the board of FIG. 2.
Figure 7:
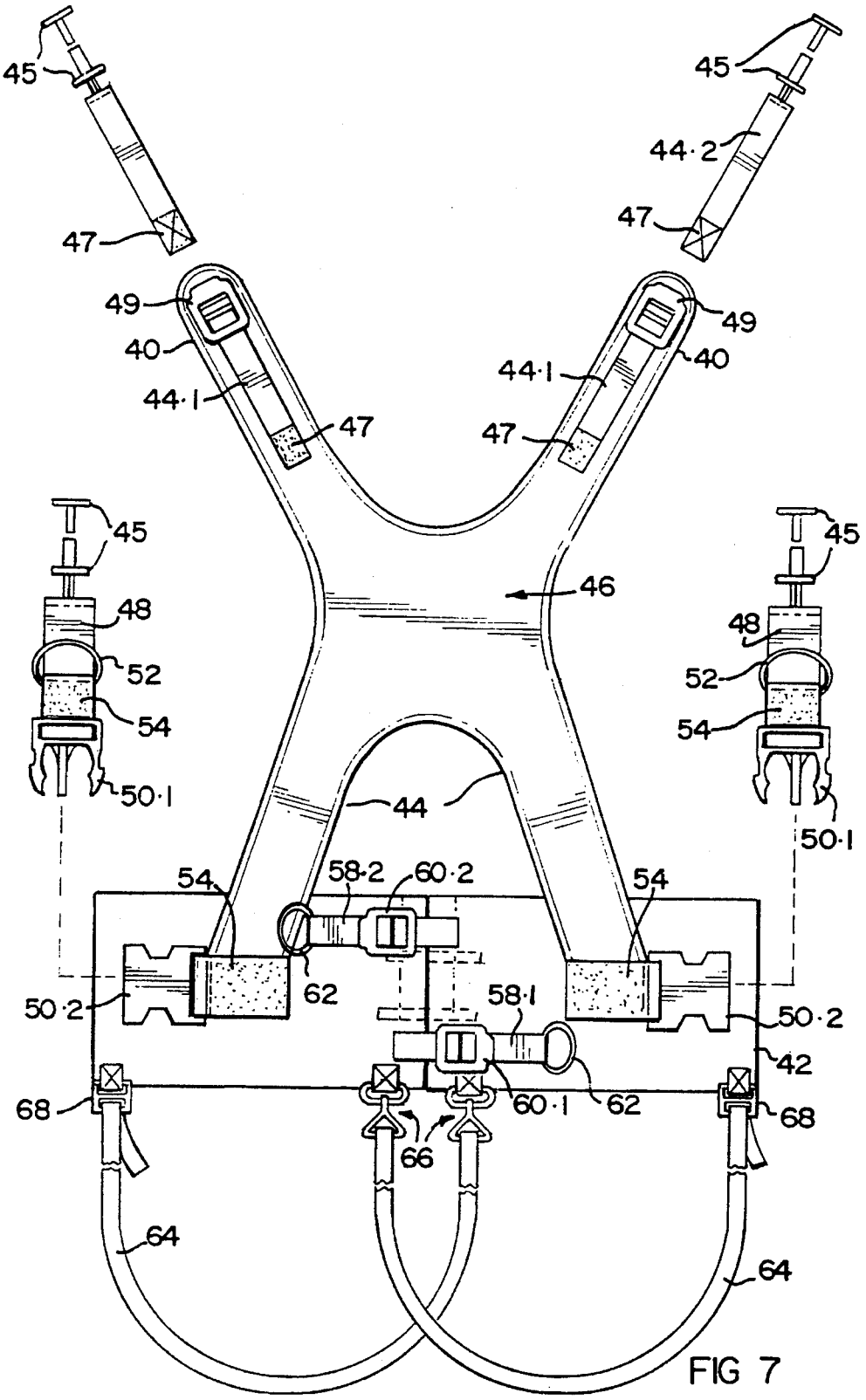
FIG. 7 shows in exploded plan view, a harness of the body surfing device of FIG. 1.

With reference to the drawings, a body surfing device for riding water waves, in accordance with the invention, is designated generally by the reference numeral 10. The body surfing device 10 comprises a board 12 and a harness 14 secured to the board 12 for strapping the board 12 to the front torso part of a person's body.

The board 12 has an upper face 16, a lower face 18, a leading end 20, a trailing end 22 and two sides 24. The upper face 16 of the board 12 defines a recess formation 26 which is formed to receive the front torso part of a person therein. More particularly, the recess formation 26 defines a chest recess 28 defining a deeper depression than the remainder of the recess formation in which the chest of a person can be received.

The board 12 is of waterproof polymeric foam rubber having a plastics sheet element 21 attached to the under side of the foam rubber, the plastics sheet element defining the lower face 18 of the board 12. The lower face 18 of the board 12 defines a smooth surface which is generally planar over a major part of the lower face 18 and which curves upwardly at the leading end 20 of the board 12. In use, the upward curvature of the lower face 18 of the board 12 at its leading end 20 provides a so-called "rocker" which serves to assist in preventing the board taking a sub-surface trajectory when moving forwards through the water on the face of or in front of a wave.

The sides 24 of the board 12 define a generally convex configuration when viewed in plan view. As such, each side 24 of the board 12 defines two side segments comprising an upper side segment 30 and a lower side segment 32. The upper side segment 30 extends between the leading end 20 and the trailing end 22 of the board 12 and also extends angularly from an outer side edge 34 of the board 12 to the upper face 16 thereof. The lower side segment 32 of each side 24 of the board 12 extends between the leading end 20 and the trailing end 22 thereof and extends angularly from the outer side edge 34 of the board 12 to the lower face 18 thereof. More particularly, the lower side segment 32 of each side 24 of the board 12 tapers from a central region thereof toward the leading end 20 and the trailing end 22 of the board 12. The upper side segment 30 of each side 24 of the board 12 tapers from the leading end 20 and the trailing end 22 of the board 12 toward a central region of the upper side segment 30.

In use, the configuration of the upper side segment 30 and the lower side segment 32 allows for increased manoeuvrability of the board 12 when riding a water wave. As such, the taper of the lower side segment 32 accommodates the upwardly curving lower face 18 of the board 12 at its leading end 20, while the tapered region of the lower side segment 32 at its trailing end 22 allows the outer side edge 34 of a particular side 24 and thus part of the upper side segment 30, to be submerged in water when the board 12 is moving forwards through the water while riding a wave to increase the drag on the board 12 to allow for turning of the board in the direction of the particular side 24. Directional control of the board 12 is achieved by a person shifting his weight on the board 12 by rolling his hips to thereby tilt the board in the direction in which turning of the board is required, to thereby cause the outer side edge 34 and part of the upper side segment 30 of the tilted side 24 of the board 12 at the trailing end 22 of the board 12 to be submerged in the water thereby creating drag to facilitate turning of the board 12.

The leading end 20 of the board 12 defines a concave edge formation 36 which permits free movement of the head of a person when the board 12 is operatively strapped to him.

The trailing end 22 of the board 12 also defines a concave edge formation 38 to accommodate the abdomen of a person when the board is strapped to him.

The harness 14 is formed of a sheet of material and comprises a number of straps which are disposed to extend around the waist and shoulders of a person when the board is strapped to him. As such, the harness 14 comprises two shoulder straps 40 which are disposed to extend around the shoulders of a person when the board is strapped to him, a waist strap 42 which is disposed to extend around the waist of a person when the board is strapped to him and two connecting straps 44 which are formed integrally with the shoulder straps 40 and which are connected to the waist strap 42. The shoulder straps 40 extend diagonally from a central region 46 disposed between the shoulder straps 40 and the connecting straps 44.

The harness 14 is attached at four attachment locations to the board 12. More particularly, the harness 14 is attached to the board 12 at two spaced locations proximate corners defined between the leading end 20 and the sides 24 of the board 12 and also at two spaced locations disposed proximate the sides 24 of the board 12 at a central position of the sides 24. As such, in order to facilitate attachment of the shoulder straps 40 and the waist strap 42 to the board 12, the body surfing device 10 includes four attachment cords 40 which are located in apertures extending through the board 12 between its upper and lower faces, at each of the four attachment locations thereof. As such, each cord 40 has a plastics plug 45 connected thereto at each end thereof. The plugs 45 are located over the openings of the apertures through the board 12 and abut the upper and lower faces of the board 12. Each of the plugs 45 defines a securing formation which can be engaged to secure the harness 14 to the board 12.

The harness 14 includes two pairs of complementary shoulder toggle straps 44.1 and 44.2 of webbing material, for securing the shoulder straps 40 to the board 12, which can be releasably secured to one another via buckles 49 associated with the toggle straps 44.1. More particularly, each toggle strap 44.1 is stitched at one end thereof to a particular shoulder strap 40 with the buckle 49 being connected to its other end. The toggle strap 44.2 is connected at one end thereof to the plug 45, the other end of the toggle strap 44.2 being a free end which can be releasably secured to the strap 44.1, via its buckle 49, in an arrangement in which the toggle strap 44.2 is pulled through the buckle 49 for tightening the shoulder strap 40 around the shoulders of a person when the board 12 is strapped to him. The toggle strap 44.1 and the free end of the strap 44.2 include complementary attachment sections 47 of a material marketed under the brand name "Velcro" to permit the free end of the strap 44.2 to be conveniently secured to the toggle strap 44.1 after it has been looped through the buckle 46 and tightened as required.

Similarly as for the shoulder straps 40, the harness 14 includes two waist toggle straps 48 of webbing material which are secured at one end thereof to the plugs 45 and which are passed through the male part 50.1 of a "quick release" buckle 50, at the other end thereof, which male part 50.1 can be inserted into a complementary female part 50.2 of the buckle 50, the female part 50.2 being stitched to the waist strap 42 of the harness 14. Each toggle strap 48 defines a free end which is passed through the male part 50.1 of the buckle 50 and which defines a loop 52 which can be manipulated by a person when the board 12 is strapped to him for pulling the free end of the toggle strap 48 tight with respect to the male part 50.1 of the buckle 50 when the male part 50.1 is engaged with the female part 50.2. As for the shoulder toggle straps 44, the waist toggle straps 48 and the waist strap 42 have complementary attachment sections 54 of Velcro which permit the said free end of each toggle strap 48 to be conveniently secured to the waist strap 42. In use, major adjustments of the waist strap 42 around the waist of a person to whom the board 12 is strapped can be achieved by pulling the free ends of the toggle straps 48 via the loops 52, to tighten the waist strap 42 around the waist of the person.

In order to effect minor adjustments of the waist strap 42 around the waist of a person, the waist strap 42 defines a flexible panel element 56 which extends across the width of the waist strap 42. Further, the waist strap 42 includes two adjustment straps 58.1 and 58.2 and associated buckles 60.1 and 60.2 respectively. As such, the strap 58.1 is secured at one end thereof to the waist strap 42 proximate one side of the panel element 56 and the buckle 60.1 is secured to the waist strap 42 proximate the other side of panel element 56, thereby permitting the strap to extend across the panel element 56 toward the buckle 60.1 around which it is looped, thereby permitting the strap 58.1 to be pulled tight in the buckle 60.1 to allow for "bunching up" of the panel element 56 to provide for further tightening of the waist strap 42 around the waist of a person. Similarly as for the strap 58.1 and the buckle 60.1, the strap 58.2 and the buckle 60.2 facilitate further tightening of the waist strap 42 by causing "bunching up" of the panel element 56. The free ends of the straps 58.1 and 58.2 have loops 62 which can be manipulated by a person for pulling the respective straps 58 tight in their associated buckles 60. As such, the loops 62 permit the straps 58 to be manipulated by a person behind his back when the board 12 is strapped to him.

The body surfing device 10 optionally includes two leg straps 64 which are secured to the waist strap 42 of the harness 14, at a central region thereof, by means of clips 66, disposed to extend from the waist strap 42 around the upper regions of the legs of a person via the person's crotch region and back to the waist strap 42 where the leg straps 64 are secured to the waist strap 42 via buckles 68 secured to the board 12, which permit tightening of the straps 64 around the legs of the person. In use, the leg straps 64 allow for the board 12 to be more securely strapped to the body of a person and in particular assist in preventing displacement of the board 12 in an upward direction when the person enters waist-deep water in an upright position with the board 12 strapped to him, due to the upward thrust of the water on the board 12. It is also envisaged that in an alternative embodiment, the leg straps 64 can be secured directly to the board 12.

The body surfing device 10 optionally includes two fins 70 which are secured to the board 12 to extend from the lower face 18 thereof proximate the trailing end 22 of the board 12. In use, the fins 70 assist in enhancing the manoeuvrability and directional control of the board 12 in the water, in use.

An advantage of the body surfing device of the invention is that it allows the same freedom of movement in the water when riding a wave, as is experienced by a person body surfing. In particular, it allows for "hands free" body surfing.

We claim:

1. A body surfing device for riding water waves, comprising a semi-rigid board formed substantially of polymeric foam having an upper face, a lower face, a leading end, a trailing end and two sides extending between the leading and trailing ends, the upper face of the board defining a recess formation formed to receive the front torso part of a person therein; and a harness secured to the board for strapping the board to the front torso part of the person's body, with the upper face of the board abutting the person's torso, the harness having a central element of sheet material that is operatively disposed substantially in the center of a person's back when the board is strapped to him, a waist strap that is connected to the central element of the harness and that is operatively disposed to extend around the waist of a person when the board is strapped to him, a pair of shoulder straps that are disposed to extend diagonally outwardly from said central element around the shoulders of a person when the board is strapped to him, the waist strap including a flexible elongate panel element having to adjustment straps that extend from opposite ends thereof and that are secured to the board, each adjustment strap being connected to the panel element via a buckle for making large-scale adjustments to the tension of the waist strap, the waist strap including at least one auxiliary adjustment strap having a buckle, that is attached to the panel element for making finer adjustment the tension in the panel element by causing bunching up of the panel element when the auxiliary adjustment straps are tightened, each shoulder strap including a buckle that permits the tension of the shoulder strap to be adjusted, the buckles of the waist strap and the shoulder straps being operatively disposed to be accessible to a person having the board strapped to himself, in use, for enabling the person to strap the board to himself and for self-adjustment of the tension in said waist strap and shoulder straps.

2. A body surfing device as claimed in claim 1, in which the lower face of the board defines a smooth surface which is substantially planar over a major part of the lower face and which curves upwardly at the leading end of the board.

3. A body surfing device as claimed in claim 1, in which the sides define a generally convex configuration when viewed in plan view.

4. A body surfing device as claimed in claim 1, in which each side of the board defines two side segments comprising an upper side segment and a lower side segment extending angularly from an outer side edge of the board to the upper face and the lower face of the board, respectively.

5. A body surfing device as claimed in claim 4, in which the lower side segment of each side of the board tapers from a central region thereof toward the leading and trailing ends of the board, with the upper side segment tapering from the leading and trailing ends of the board toward a central region of the upper side segment.

6. A body surfing device as claimed in claim 1, in which the leading end of the board defines a concave edge formation to permit free movement of the head of a person when the board is operatively strapped to him.

7. A body surfing device as claimed in claim 1, in which the trailing end of the board defines a concave edge formation to accommodate the abdomen of a person when the board is strapped to him.

8. A body surfing device as claimed in claim 1, which includes two leg straps which are each secured to the board and disposed to extend therefrom around the upper regions of the legs of a person via the person's crotch region and back to the board, when the board is strapped to him.

9. A body surfing device as claimed in claim 1, which includes at least one fin which is secured to the board to extend from the lower face of the board.

10. A body surfing device as claimed in claim 1, in which the board has a plastic sheet element attached to the operative underside of the polymeric foam, the plastic sheet element defining a smooth surface on its operative underside.

* * * * *

UNITED STATES PATENT AND TRADEMARK OFFICE

CERTIFICATE OF CORRECTION

PATENT NO. : 5,569,057

DATED : October 29, 1996

INVENTOR(S) : Gary Keith Barsdorf and Deon Dirk Schoeman

It is certified that error appears in the above-indentified patent and that said Letters Patent is hereby corrected as shown below:

In col. 5, line 26, please change "to" to --two--.

In col. 5, line 33, please change "adjustment" to --adjustments to--.

Signed and Sealed this

Eleventh Day of March, 1997

*Attest:*

*Attesting Officer*

BRUCE LEHMAN

*Commissioner of Patents and Trademarks*